United States Patent [19]

Lucas

[11] Patent Number: 4,835,534

[45] Date of Patent: May 30, 1989

[54] MONITORING A CONFLICT DETECTOR FOR TRAFFIC-LIGHTS

[75] Inventor: Ian R. Lucas, St. Ives, Australia

[73] Assignee: U.S. Philips Corp., New York, N.Y.

[21] Appl. No.: 903,043

[22] Filed: Sep. 2, 1986

[30] Foreign Application Priority Data

Sep. 5, 1985 [AU] Australia ..... PH02299

[51] Int. Cl.[4] ..... G08G 1/097

[52] U.S. Cl. ..... 340/931; 340/907; 340/912; 340/825.16; 371/26

[58] Field of Search ..... 340/907, 909, 912, 924, 340/931, 825.16; 371/60, 71, 26

[56] References Cited

U.S. PATENT DOCUMENTS

| | | | |
|---|---|---|---|
| 3,497,685 | 2/1970 | Stafford | 371/26 |
| 3,629,802 | 12/1971 | Clark et al. | 340/931 |
| 3,857,061 | 12/1974 | Boudault et al. | 340/931 |
| 3,902,156 | 8/1975 | Hill | 340/931 |
| 4,039,813 | 8/1977 | Kregness | 371/26 |
| 4,059,749 | 11/1977 | Feilchenfeld | 371/60 |
| 4,135,145 | 1/1979 | Eberle | 340/931 |
| 4,290,136 | 9/1981 | Brunner et al. . | |
| 4,383,240 | 5/1983 | Staats, Jr. | 340/931 |
| 4,463,339 | 7/1984 | Frick et al. | 340/931 |
| 4,551,718 | 6/1983 | Cookson et al. | 340/825.16 |
| 4,566,008 | 1/1986 | Powers et al. | 340/515 |
| 4,586,041 | 4/1986 | Carlson | 340/931 |

FOREIGN PATENT DOCUMENTS

| | | | |
|---|---|---|---|
| 3428444 | 2/1986 | Fed. Rep. of Germany | 340/931 |

*Primary Examiner*—Joseph A. Orsino
*Assistant Examiner*—Brent A. Swarthout
*Attorney, Agent, or Firm*—Bernard Franzblau

[57] ABSTRACT

A monitoring system for energization of traffic lamps (L 1 . . . L 8), with energy supplied from a common voltage source. Protection is provided so that energization of any one of the lamps is not in conflict with energization of another lamp. The system includes a conflict detection means (CD) having a set of inputs respectively connected to monitor individual lamps so that respective inputs of the set are activated in response to energization of respective lamps. The conflict detection means generate conflict signifying information in response to simultaneous activation of combinations of inputs. A signal group generator (SGG) feeds to the inputs a sequence of data signal groups each simulating a conflict or a non-conflict combination at the inputs. The resultant information produced by the conflict detection means (CD) is checked for correctness by a verification means under common control with the signal generator. The signal groups being fed to the inputs within short intervals during blank time-spaces when no information is fed thereto. A processor (CPU) has an acceptance limit for producing conflict-warning information in response to conflict signifying information within the acceptance limit. This limit is chosen so that the processor is non-responsive to conflict signifying information resulting from data present only within such simulation signal intervals.

19 Claims, 3 Drawing Sheets

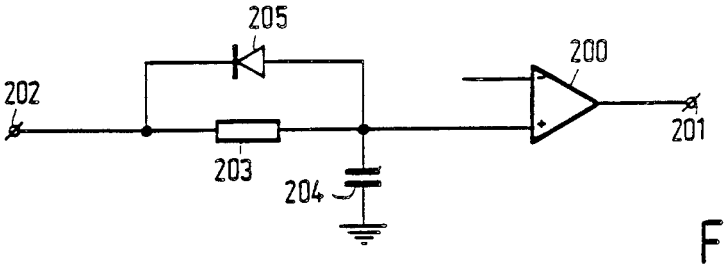
FIG.2a
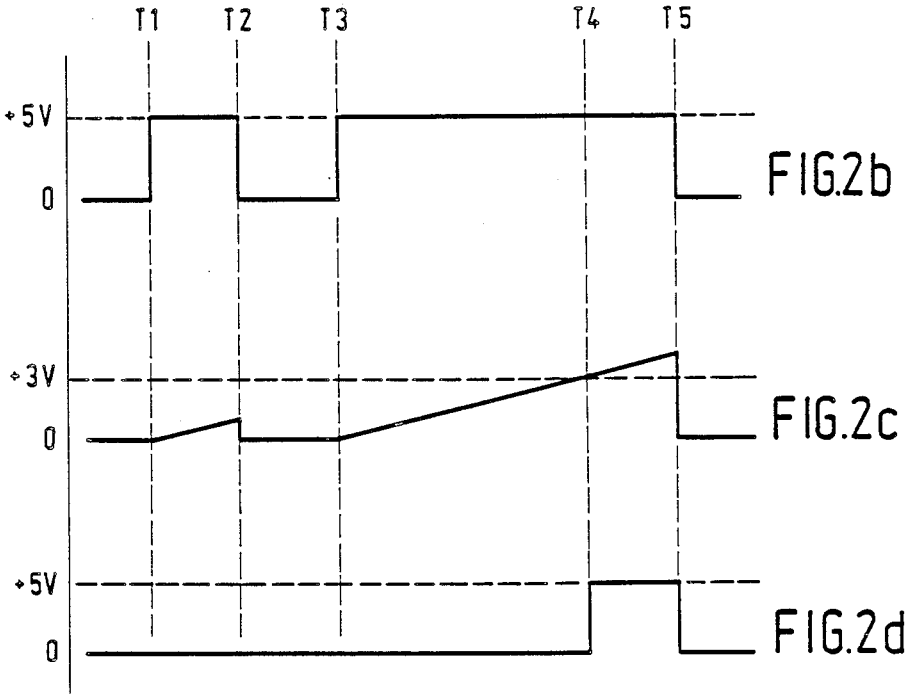
FIG.2b
FIG.2c
FIG.2d

MONITORING A CONFLICT DETECTOR FOR TRAFFIC-LIGHTS

BACKGROUND OF THE INVENTION

The present invention relates to monitoring systems for monitoring individual energization of a plurality of energizable units, each connected for controlled switching of energy supplied from a common alternating voltage supply source, and for providing protection against energization of one of the units being in conflict with energization of another unit of the plurality, the system comprising a conflict detection means provided with a set of input terminals respectively connected, via individual monitor paths, to monitor individual energizable units or groups of energizable units so that respective input terminals of the set are activated in response to energization of respective individual units or groups of units, the conflict detection means generating conflict signifying information at an output thereof in response to simultaneous activation of predetermined combinations of input terminals of the set.

Such monitoring systems are already known and are generally provided with conflict protection means which are activated in response to conflict signifying information derived from the conflict detection means. Such conflict protection means may, for example, operate a relay for switching off the alternating voltage supply to all energizable units upon activation in response to conflict signifying information from the conflict detection means. Protection means for carrying out other kinds of protective functions are known and their features depend upon the character of the apparatus of which the energizable units form a part.

Although not intended to be restricted thereto, the present invention is, in particular, applicable to monitoring systems for monitoring energizable units such as signal lamps in a traffic signalling apparatus. It will be appreciated in the case of traffic signal apparatus for a road intersection employing groups of red, green and amber signals that a failure of a conflict detection means to generate conflict signifying information in respect of, for example, simultaneous energization of two lamps respectively corresponding with green signals for intersecting roadways could be dangerous. Accordingly, it is important for monitoring systems of the kind to which the invention relates to be designed for highly reliable operation and with fail-safe characteristics where practical.

For the foregoing reasons, in monitoring systems of the kind to which the invention relates it is known to operate two similar conflict detection means in parallel with each other so as to provide a safe-guard in the event of failure of one of the conflict detection means.

One known conflict detection means which may be provided is a so-called "diode matrix" comprising two sets of spaced conductors orthogonal to each other in a crossbar arrangement, each conductor of one conductor set being connected to a corresponding conductor of the other conductor set and to a corresponding input terminal. A diode matrix is able to be wired to produce conflict-indicating information in response to two given inputs of the matrix being simultaneously energized by the connection of diodes across appropriate intersecting matrix conductors corresponding with the given inputs.

Wiring a diode matrix requires the diode connections between appropriate intersecting matrix conductors to be provided by hand soldering, which is a time-consuming and costly process.

When duplicate conflict detection means are operated in parallel to improve reliability of a monitoring system, it is possible for the monitoring system to operate satisfactorily even though one of the conflict detection means is defective and the condition of the defective conflict detection means will not become known to the operators of the system until revealed by a subsequent routine manual service check of the system. In these circumstances, the failure of the remaining conflict detection means before such a routine manual service check could result in the danger of conflicting traffic signals being displayed. Routine manual service checks at frequent intervals are necessary to maintain an adequate level of protection.

SUMMARY OF THE INVENTION

An object of the present invention is to provide a monitoring system of the kind to which the invention relates which is highly reliable.

Another object of the present invention is to provide a monitoring system of the kind to which the invention relates having self-checking properties.

The present invention provides a monitoring system for monitoring individual energization of a plurality of energizable units, each connected for controlled switching of energy supplied from a common alternating voltage supply source, and for providing protection against energization of any one of the units of the plurality being in conflict with energization of another unit of the plurality. The system comprises; a conflict detection means provided with a set of input terminals respectively connected, via individual monitor paths, to monitor individual energizable units or groups of energizable units so that respective input terminals of the set are activated in response to energization of respective individual units or groups of units. The conflict detection means generate conflict signifying information at an output thereof in response to simultaneous activation of pre-determined combinations of input terminals of the set. A signal group generator feeds to the set of input terminals a sequence of data signal groups each simulating a conflict or a non-conflict combination at the input terminals of the set. The resultant information produced thereby at the said output of the conflict detection means is checked for correctness by a verification means under common control with the signal group generator. The signal groups of the sequence are fed to the input terminals within simulation signal intervals of fixed duration that are short relative to the supply cycle period and timed to occur during blank time-spaces when no information is fed thereto via the monitor paths, an information processing stage having an acceptance time interval (acceptance limit) for producing conflict-warning information in response to conflict signifying information present at the conflict detection means output when within the acceptance limit. Conflict protection means are arranged to be activated in response to such conflict-warning information, the acceptance time interval being such that the information processing stage is non-responsive to conflict signifying information resulting from data supplied only within such simulation signal intervals.

The said information processing stage may take any one of a variety of different forms and the response characteristics or features of the said information processing stage which dictate the said acceptance limit may also take different forms dependent upon the properties desired in the overall system.

In many practical embodiments of the invention, the said fixed duration and the chosen recurrence rate for the said simulation signal intervals will permit the said acceptance limit to be based upon the time period required for a chargeable element, forming part of the information processing stage, to be charged to a threshold level by conflict signifying information produced at the output of the conflict detection means. Alternatively, the said acceptance limit may be based upon the timing of the said simulation signal intervals with synchronous operation of active elements forming part of the information processing stage for inhibiting response during corresponding times.

In one form of the invention, a chargeable element in the form of a capacitance is connected across the data input terminals of a resettable information latch, the output of the conflict detection means being fed via a resistance to the data input of the information latch so that the resistance and capacitance function as an integration network which, in combination with the information latch serves as the said information processing stage. In this form of the invention, the time constant of the integration network determines a latch delay time for charging the capacitance from zero to the threshold level for latch activation. The time constant of the integration network is chosen so that the latch delay time is longer than the said fixed duration. Accordingly, provided the capacitance is in a discharged state and conflict signifying information is produced at the conflict detection means output for a period of time equal to or less than the said fixed duration, the latch will not respond. However, should conflict signifying information be produced at the conflict detection means output for a period of time longer than the said latch delay time then the capacitance will be charged sufficiently for the threshold level to be exceeded causing the latch to be activated and conflict warning information to be generated at the latch output.

Also with this form of the invention, the information latch is connected so as to be reset by reset pulses so timed that a reset pulse occurs just prior to each said simulation signal interval. As a result, provided the time constant of the integration network is sufficiently large for the charge on the capacitance to remain above the input threshold level of the latch for the duration of the reset pulse, then the latch will function as a so-called stretching latch. When connected to function as a stretching latch, the output of the latch is activated in response to conflict signifying information continuously present at the conflict detection means output for a period of time exceeding said fixed duration and remains activated at least until reset of the stretching latch. However, in addition, whenever the output of the stretching latch is already active at the instant of reset as a result of conflict signifying information supplied thereto via the integration network, provided the conflict signifying information is still present at the occurrence of a reset pulse, the output of the stretching latch will remain active until at least the next succeeding reset pulse. In other words, the stretching latch is only reset by a reset pulse if no conflict signifying information is present at its input at the time of the reset pulse.

Generally speaking, the duration of a reset pulse employed in a system in accordance with the invention will be shorter than the said fixed duration of the said simulation signal intervals so that the time constant of such an integration network will be of sufficient length to ensure operation of the latch as an information stretching latch in the manner referred to. This assumes the charge rate and discharge rate of the capacitance of the integration network are governed by the same time constant. An appropriate choice of resistance values will ensure correct operation as an information stretching latch for instances when the capacitance discharge path is different than its charge path. The applicant's co-pending Australian Patent Application No. PHC 35584 describes the operation of a stretching latch for a related purpose.

It is advantageous for the said conflict protection means to respond only to activation by conflict warning information for a continuous period of time exceeding a predetermined conflict measurement period.

It is important for data signals from the signal group generator to be applied to the said set of input terminals only when no information is being fed thereto from another source. For this purpose, a terminal protection system may be provided which inhibits operation of the signal group generator unless all input terminals of the set are inactive. Moreover, unless the monitoring system is of a kind operating so that the information fed via the individual monitor paths ceases from time to time, so that consequently all input terminals of the said set are simultaneously inactive, provision of a keying system may be needed for isolating the said set of input terminals from the said individual monitor paths during keying intervals, thus providing blank time-spaces for accommodating said simulation signal intervals and thereby permitting simultaneous operation of the signal group generator. With such a keying system, care must be taken to ensure the keying process cannot override normal monitoring operations.

Provision of blank time-spaces for accommodating said simulation signal intervals is possible by means other than by way of a keying system. For example, a monitoring system is described in the applicants co-pending Australian Patent Application No. PHC35584 based upon the use of a monitoring path incorporating a voltage comparator and a sensing latch (as defined therein) which is periodically reset at intervals corresponding with zero crossover of the alternating supply voltage for the energizable units being monitored. The use of such a monitoring path via which the terminals of said set are individually connected to monitor individual energizable units in a monitoring system according to the present invention periodically provides a blank time-space during each cycle of alternating supply voltage having no information present and of adequate duration to accommodate a said simulation signal interval during which operation of the signal group generator is permissible. In the interests of system reliability, the use of monitoring paths operating on a similar basis is preferable to the use of a keying system in which there is isolation of the set of input terminals from the individual monitor paths.

In one form of the invention, the said signal group generator and the said verification means operate under the common control of a central processing unit, the verification means including a reference memory containing reference information permitting respective identification of conflict and non-conflict combinations represented by individually fed data signal groups. The reference memory may have separate memory locations which respectively contain data duplicating the resultant information intended to be produced by the conflict detection means in response to respective corresponding data signal groups of the sequence. As an alternative, the reference memory may be of a kind which provides comparison data resulting from comparison between individual data bits of any fed data signal group with the reference memory, in this case, operating in combination with the central processing unit in such a way that comparative analysis is performed in relation to alternative data-bit-combinations representing potential conflict in each fed data signal group. Other alternative kinds of reference memories will be conceivable by persons skilled in the art.

Preferably the said conflict detection means incorporates an addressable conflict data memory, the address terminals of which form the said set of input terminals, with the said conflict information being stored at those memory locations of the conflict data memory matching memory location addresses corresponding with activation of the respective said pre-determined combinations of input terminals of the set. Each data signal group of the sequence is related to a memory location address within the conflict data memory and is also related to correspondingly identifiable reference information stored within the said reference memory. With each advance of the sequence under the control of the central processing unit there is a corresponding advance to the next respective identification by way of the reference memory, and the resultant output of the conflict detection means is compared with the resultant reference information of the reference memory so that a fault condition in the conflict detection means is detected in the event of non-correspondence between the two.

BRIEF DESCRIPTION OF THE DRAWINGS

The invention will now be described in greater detail with reference to the accompanying drawings in which:

FIG. 2(*a*) is a diagram showing in greater detail a portion of the system of FIG. 1.

FIGS. 2(*b*),(*c*) and (*d*) each depict a wave form to explain the operation of the circuit arrangement of FIG. 2(*a*).

DESCRIPTION OF THE PREFERRED EMBODIMENTS

Figure 1:
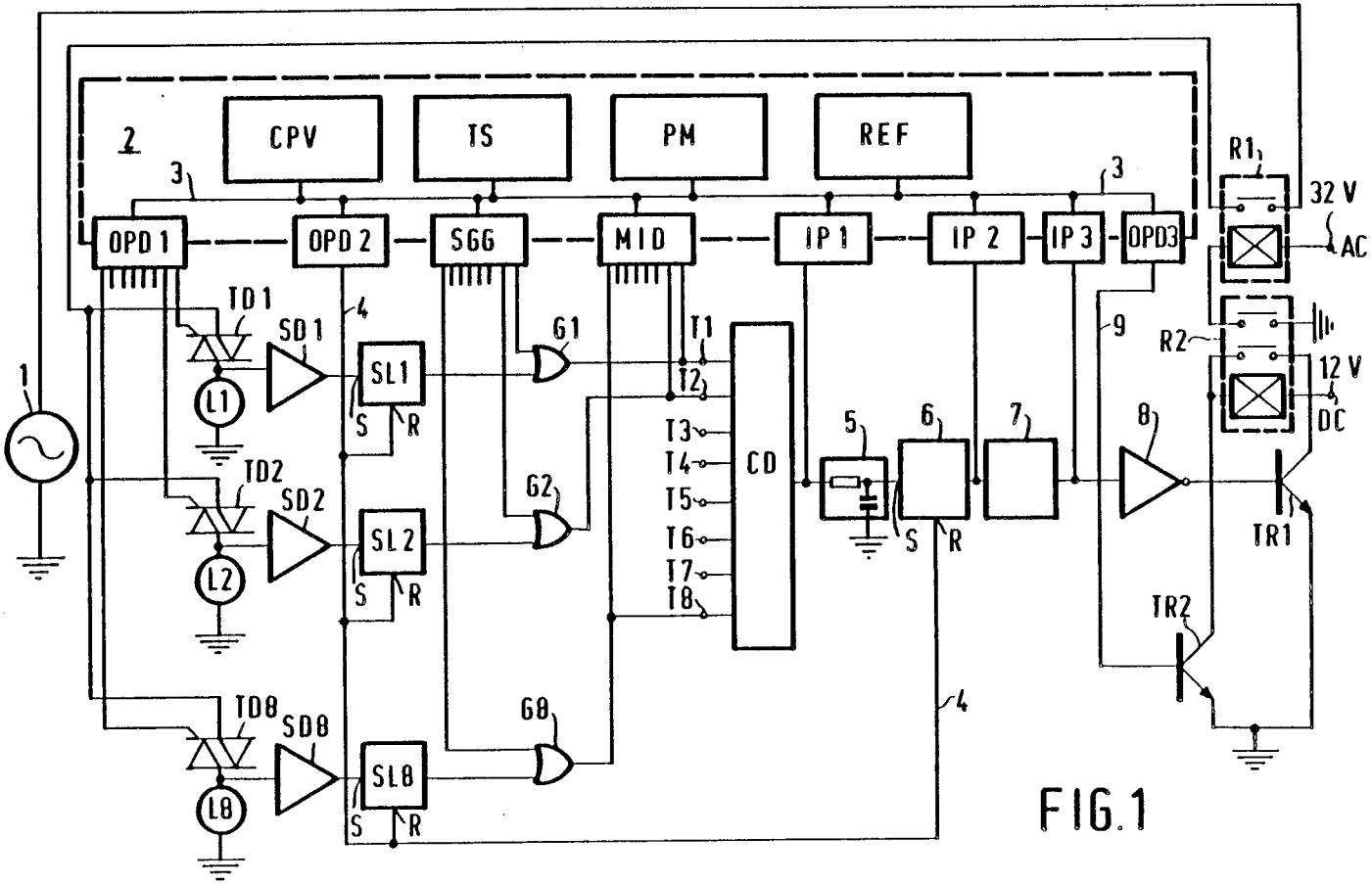
FIG. 1 is a schematic circuit diagram of a traffic control and monitoring system in accordance with the invention.

In the system of FIG. 1, a plurality of traffic signal lamps L1, L2 to L8 are individually energized from an alternating voltage supply source 1 under the control of a micro-computer denoted by the numeral 2. The lamps L1 to L8 are each connected via one of the triac devices TD1 to TD8 and via the contacts of the relay R1 to the supply source 1, the respective trigger electrodes of the triac devices TD1 to TD8 being connected to the respective output terminals of the output device OPD1 of the micro-computer 2.

The micro-computer 2 comprises a central processing unit CPU, a program memory PM, a temporary store memory TS and a reference memory REF interconnected with each other via a common bus system denoted by the numeral 3. A plurality of input and output devices are also connected to the common bus 3 and serve as interfaces with the remainder of the traffic control and monitoring system of FIG. 1.

The conductivity of the respective triac devices TD1 to TD8 is controlled by the central processing unit CPU in accordance with the computer program stored in the memory PM which accordingly, provided the contacts of the relay R1 are closed, also controls the energization of the respective signal lamps L1 to L8. Although the nature of control of the energization of signal lamps L1 to L8 does not form part of the present invention, it will be understood that accidental simultaneous energization of two or more of the traffic signal lamps L1 to L8 could be dangerous to traffic.

The monitoring system of FIG. 1 provides safeguards against undesired simultaneous energization of two or more of the traffic signal lamps L1 to L8 by means of a conflict detection means CD provided with a set of input terminals T1 to T8 connected via individual monitor paths to sense respective energization of the signal lamps L1 to L8 so that in the event that a conflict is detected, a signal is produced at the output of the conflict detection means CD which, via subsequent control circuitry, causes the contacts of the relay R1 to be opened with the result that the signal lamps L1 to L8 cease to be energized.

Information as to the state of energization or otherwise of the respective signal lamps L1 to L8 is fed to the conflict detection means CD by way of individual monitor paths. For example, the junction between the lamp L1 and the triac device TD1 is connected to the terminal T1 of the conflict detection means CD via a voltage sensing device SD1, a sensing latch SL1 and an OR gate G1. Similarly, the respective junctions of the lamps L2 to L8 with associated triac devices TD2 to TD8 are respectively connected to the terminals T2 to T8 of the conflict detection means CD, each via one of the voltage sensing devices SD2 to SD8, one of the sensing latches SL2 to SL8 and one of the OR gates G2 to G8.

In this description, reference is made to the signal lamps L1 to L8, to the triac devices TD1 to TD8, to the sensing devices SD1 to SD8, to the sensing latches SL1 to SL8 and to the gates G1 to G8. However, the lamps L3 to L7, the triac devices TD3 to TD7, the sensing devices SD3 to SD7, the sensing latches SL3 to SL7 and the gates G3 to G7 are not depicted in FIG. 1. It will be understood that the lamps L3 to L7 are each controlled by the micro-computer 2 in the same way as the lamps L1, L2 and L8 and are each connected via a similar monitor path to one of the input terminals of the conflict detector CD as are the lamps L1, L2 and L8.

The sensing latches SL1 to SL8 are conventional electronic latches with an output having either an active state or an inactive state, a set input and a reset input wherein with the output in the active state the state of the output is not affected by the state of the set input but is changed to the inactive state by activation of the reset input, whereas with the output in the inactive state the state of the output is not affected by the state of the reset input but is changed to the active state by activation of the set input.

The voltage sensing device SD1 is sensitive to a voltage of sufficient magnitude developed across the lamp L1 and the output of the device SD1 is activated whenever the voltage across the lamp L1 exceeds a given reference voltage relative to 0 in either direction. Following each reset, the sensing latch SL1 reacts to the output voltage of the voltage sensor SD1, the output of the latch SL1 being activated in response to each activation of the output of the device SD1. The output device OPD2 of the micro-computer 2 supplies a reset pulse of short duration to a reset line 4 substantially coincident with each zero voltage crossover from negative to positive of the alternating voltage of the source 1. The reset terminals of the sensing latches SL1 to SL8 are connected to the reset line 4 so that the latches are all reset coincident with each such zero voltage crossover. Accordingly, continuous supply of the alternating supply voltage to the lamp L1 from the source 1 results in continuous activation of the output of the latch SL1 interrupted for a short interval during each cycle of the supply voltage for an interval extending between such zero voltage crossover to the instant at which the given reference voltage is exceeded at the input of the sensing device SD1. Activation of the output of the sensing latch SL1 results in activation of the output of the gate G1 and of the terminal T1 of the conflict detection means CD. A similar monitor path to that described as extending between the junction of the lamp L1 with the triac device TD1 and the terminal T1 of the conflict detection means CD also extends between the respective junctions of the lamps L2 to L8 with their associated triac devices TD2 to TD8 and the respective terminals T2 to T8 of the conflict detection means CD, the operation of these monitor paths being similar to each other with simultaneous reset of the sensing latches of all eight monitor paths.

The conflict detection means CD is in the form of a programmable read-only memory, for example a portion of a type 2716 Eprom. The eight terminals T1 to T8 are the address terminals of the read-only memory. With an eight-terminal address system, 256 different input data combinations are possible. Before being put into operation the read-only memory forming the conflict detection means CD is programmed so that appropriate address locations produce a logic "1" (signifying a conflict condition), whereas the remainder produce a logic "0" in response to input data at the terminals T1 to T8. It will be understood the programming of a read-only memory forming a conflict detection means CD is individual to the particular purpose for which the traffic signal lamps L1 to L8 are employed.

The output of the conflict detection means CD is fed via an integrator 5 to the input of a further latch circuit 6, to the reset terminal of which the line 4 also supplies reset pulses of short duration as previously described. The latch 6 is a conventional electronic latch also of the kind previously described.

The integrator 5 is in the form of a resistance-capacitance network having a time-constant greater than the said fixed duration. The said fixed duration is the length of the interval when a simulation signal supplied by a signal generator SGG in the form of a data group as discussed hereafter is present at the output terminals of the conflict detector CD. In practice, in the case of a 50 cycles per second mains supply for the source 1, the duration of the chosen fixed duration is approximately 100 micro-seconds and the chosen time constant for the integrator 5 should be significantly greater than 100 micro-seconds, for example one millisecond. The effect of the integrator 5 and the latch 6 in cascade is that, in the event of the output of the conflict detection means CD being active for only the latter part of each alternating cycle, the output of the latch 6 will be active for the whole of the next cycle.

The latch circuit 6 is followed by a conflict protection means which reacts to the output of the latch 6 being activated continuously for a period in excess of a predetermined conflict measurement period. This conflict protection means includes the relay R1, the relay R2, the transistors TR1 and TR2, the reaction timer stage 7 and the inverter 8.

As previously described, the contacts of the relay R1 serially connect the supply source 1 to the common supply line for the lamps L1 to L8 so that the supply of energy to the lamps L1 to L8 is disconnected if the contacts are open-circuited. The winding of the relay R1 is connected via a first set of contacts of the relay R2 across a thirty-two volt alternating current supply source (not shown) so that the relay R1 is energized and there is resultant closure of the contacts of the relay R1 provided the winding of the relay R2 is energized. The relay R2 has two sets of contacts and the winding of the relay R2 is connected across a twelve volt direct current supply source (not shown) via two separate paths. A first path is formed by the collector-emitter path of the transistor TR2 and a second path is formed by the serial combination of the second set of relay contacts for the relay R2 and the collector-emitter path of the transistor TR1. The base electrode of the transistor TR2 is connected via the line 9 to the output device OPD3 of the micro-computer 2 whereas the base electrode of the transistor TR1 is connected to the output of the inverter 8.

Briefly, the operation of the conflict protection means is as follows. Each time the system of FIG. 1 is switched into operation under the control of the program stored by the memory PM, the central processing unit CPU causes, by way of the output device OPD3 a positive going pulse of short duration to be fed to the line 9, switching-on the transistor TR2 and thereby making the abovementioned first path conductive so that current flow from the twelve volt supply source energizes the winding of the relay R2 causing closure of both sets of relay contacts of the relay R2. Closure of both sets of relay contacts of the relay R2 results in energization of the winding of the relay R1 and consequent supply of voltage from the supply source 1 to the lamps L1 to L8 and also results in completion of the abovementioned second path provided that the output of the inverter 8 is "high" causing switch-on of the transistor TR1. In this respect, in operation the output of the inverter 8 is always "high" unless a continuous conflict situation has been detected by the reaction timing stage 7. Owing to completion of the abovementioned second path formed by the emitter-collector path of the transistor TR1 and the second set of contacts of the relay R2, provided the output of the inverter 8 is indeed "high", the winding of the relay R2 continues to be energized from the twelve volt DC supply source subsequent to termination of the positive going pulse on the line 9 and turn-off of the transistor TR2.

FIG. 2*a* is a schematic diagram of the reaction timer stage 7 of FIG. 1. The circuit arrangement of FIG. 2*a* comprises a differential amplifier 200, the output of which is connected to the output terminal 201 of the stage. The input terminal 202 of the stage is connected via a resistance 203 to the positive input of the differential amplifier 200 which is connected via a capacitance 204 to ground potential. The resistance 203 is shunted by a diode 205. Owing to the unidirectional conducting properties of the diode 205, the network formed by the capacitance 204, the resistance 203 and the diode 205 has a rapid discharge time-constant relative to its charge time-constant. The negative input of the amplifier 200 is connected to a source of fixed potential of +3 volts (not shown).

In operation, the output terminal 201 is "low" unless the voltage applied to the positive input of the amplifier 200 exceeds the potential of the negative terminal (i.e. exceeds +3 volts).

FIGS. 2(*b*), 2(*c*) and 2(*d*) show the results of supplying a logic "1" signal to the input terminal 202 for different periods of time. FIG. 2(*b*) shows a voltage wave form supplied to the input terminal 202 from the output of the latch 6. FIG. 2(*c*) shows the resultant voltage wave form developed across the capacitance 204 and FIG. 2(*d*) shows the resultant voltage wave form produced at the output terminal 201. In FIGS. 2(*b*) and 2(*d*), the presence of a logic "1" corresponds with the 5 volt level denoted by a horizontal dotted line in each case whereas the horizontal dotted line in FIG. 2(*c*) corresponds with the +3 volt reference level set by the potential applied to the negative input of the amplifier 200.

As shown by FIG. 2(*b*), the input 202 is activated by the presence of a logic "1" between the instants T1 and T2 and again between the instants T3 and T5. As a result, the capacitance 204 is slowly charged via the resistance 203 between the instants T1 and T2 but is rapidly discharged via the diode 205 following the instant T2 when the terminal 202 is no longer activated by a logic "1". The period of time between the instants T1 and T2 is insufficient for the charge on the capacitance 204 to reach the +3 volt reference level.

When the input 202 is again activated at the instant T3, the capacitance 204 is again slowly charged via the resistance 203 and again rapidly discharged following the instant T5. As indicated by FIG. 2(*c*), at the instant T4 the charge on the capacitance 204 exceeds the +3 volt reference level set by the voltage applied to the negative input of the amplifier 200 causing the output 201 to be activated between the instants T4 and T5 as depicted by FIG. 2(*d*), the output 201 returning to the inactive state following the instant T5.

In practice, the (charging) time-constant of the capacitance 204 in combination with the resistance 203 is selected so that it is necessary for the input 202 (i.e. the output of the latch 6) to be active for approximately 80 milliseconds for the charge on the capacitance 204 to reach the +3 volt reference level, causing activation of the output 201. A period of 80 milliseconds corresponds to four complete cycles of an alternating supply having a frequency of 50 cycles per second.

From the foregoing description of the operation of the reaction timer stage 7, and with a selected time constant to correspond with 80 milliseconds, it will be appreciated that the presence of conflict signifying information at the output of the latch 6 for 80 milliseconds or more causes the output of the inverter 9 to become "low", turning-off the transistor TR1, causing the relay R1 and also the relay R2 to drop out thereby disconnecting the supply to the lamps L1 to L8. However, the continuous presence of conflict signifying information at the output of the latch 6 for a period less than 80 milliseconds has no effect upon the output of the reaction timer stage 7.

In the event of drop-out of the relay R1, the system is able to be restored to its former operation under the control of the microprocessor 2 by application of a further positive going pulse to the base electrode of the transistor TR2 via the output port OPD3 and the line 9.

Figure 3:
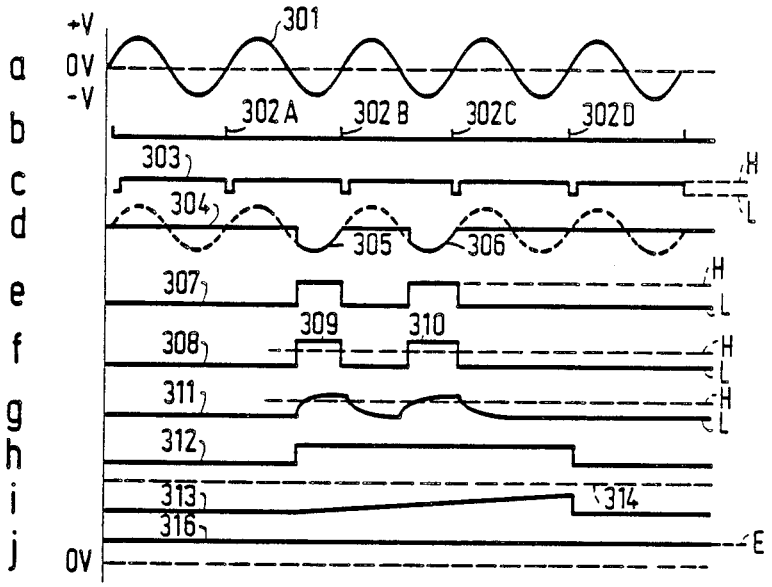
FIG. 3 shows a set of typical waveforms present at respective parts of the system of FIG. 1 under certain operating conditions.
Figure 4:
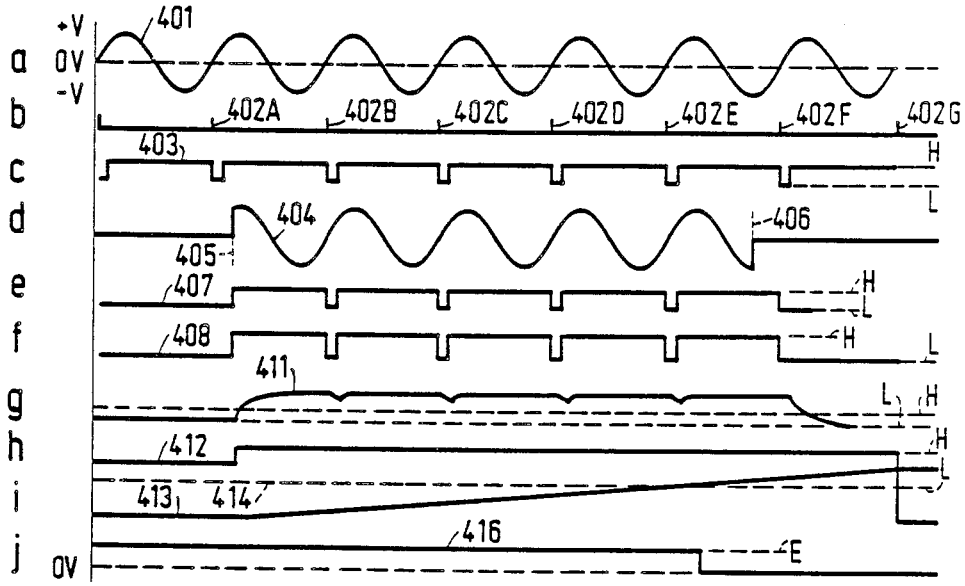
FIG. 4 shows a set of typical waveforms present at respective parts of the system of FIG. 1 under different operating conditions to those of FIG. 3.

The waveforms of FIG. 3 and of FIG. 4 will assist a reader in understanding the system of FIG. 1.

The wave forms of FIG. 3 represent, by way of example, those present at different parts of the system of FIG. 1 for conflict conditions of short time duration. For purposes of description, it is assumed simultaneous energization of signal lamp L1 and signal lamp L2 is a conflict condition. FIGS. 3(*a*) to 3(*j*) are in the same time relationship.

FIG. 3(*a*) shows a voltage waveforms 301 developed across the lamp L1, this waveforms being the same as that of the terminal voltage of the supply source 1 which supplies an alternating common supply voltage having a frequency of 50 cycles per second. FIG. 3(*b*) shows a waveforms of a train of reset pulses supplied to the supply line 4, each reset pulse 302A, 302B, 302C etc having a pulse width of approximately 30 microseconds. There is an interval of 20 milliseconds between successive negative-to-positive zero crossover points of the waveforms 301 and an interval of similar length between the leading edges of successive reset pulses 302A, 302B, 302C etc.

The waveforms 303 of FIG. 3(*c*) shows the output of the sampling latch SL1. The voltage level denoted by the letter H is the "high" or active level corresponding with a logic "1" whereas the level denoted by L is the "low" or inactive level corresponding with a logic "0". Each reset of the sampling latch SL1 by a reset pulse 302 sets the output voltage to "low" but the output voltage goes "high" as the next positive-going cycle of the supply voltage exceeds the previously-mentioned predetermined level of the sensing device SD1.

FIG. 3(*d*) shows a voltage waveform 304 developed across the signal lamp L2.(The dotted line corresponds with the common supply voltage wave shape). The half-cycle portions 305 and 306 correspond with accidental energization of the lamp L2. FIG. 3(*e*) shows a voltage waveform 307 produced at the output of the sampling latch SL2 in response to the waveform 304 present across the lamp L2. A similar waveform to wave form 303 is supplied via the gate G1 to the terminal T1 of the conflict monitor CD and a similar waveform to the waveform 307 is supplied via the gate G2 to the terminal T2. FIG. 3(*f*) shows a voltage waveform 308 produced at the output of the conflict detector CD in response to the waveforms simultaneously fed to the terminals T1 and T2. The pulses 309 and 310 correspond with the parts of the waveforms 307 and 303 which are simultaneously at a "high" level, i.e. conflict signifying information is produced at the output of the monitor CD with simultaneous energization of the lamps L1 and L2.

FIG. 3(*g*) shows a voltage waveform 311 produced at the output of the integrator 5 in response to the waveform 308 at its input and FIG. 3(*h*) shows a resultant voltage waveform 312 at the output of the latch 6. It will be noted that the waveform 312 goes to the "high" level when the waveform 311 reaches the "high" level and returns to the "low" level simultaneously with the reset pulse 302D. The latch 6 is not reset by the reset pulses 302B and 302C because at the time of occurrence of those reset pulses, owing to the operation of the integrator 5, the input of the latch 6 is still at a "high" level and application of the reset pulses to the latch 6 has no effect.

FIG. 3(*i*) shows a voltage waveform 313 developed across the capacitance 204 of the reaction timer stage 7, the +3 volt level being denoted by the horizontal dotted line 314. FIG. 3(*j*) shows a waveform 316 corresponding with the magnitude of current flow in the winding of the relay R1, thus corresponding with the presence of the common voltage supply for the signal lamps. The duration of the "high" portion of the wave form 312 is insufficient in this case for the charge on the capacitance 204 to reach the +3 volt level and so the relay R1 remains energized and the common voltage supply is not disconnected.

The wave forms of FIG. 4 represent, also by way of example, the wave forms present at different parts of the system of FIG. 1 for conflict conditions of longer time duration. Again, it is assumed simultaneous energization of the signal lamps L1 and L2 is a conflict situation. FIGS. 4(*a*) to 4(*j*) are in the same time relationship.

FIG. 4(*a*) corresponds with FIG. 3(*a*) and shows a voltage wave form 401 developed across the lamp L1 supplied from the common supply source 1. FIG. 4(*b*) corresponds with FIG. 3(*b*) also showing a train of reset pulses 402A, 402B etc. present on the supply line 4 and FIG. 4(*c*) corresponds with FIG. 3(*c*) showing a wave form 403 which is the resultant output voltage wave form of the sampling latch SL1. Here, as in the case of FIG. 3(*c*), the output voltage of the latch SL1 is set to "low" with each reset pulse and goes "high" as the next positive-going cycle of the supply voltage across the lamp L1 exceeds the predetermined level of the sensing latch SD1.

As in the case of FIG. 3(*d*), FIG. 4(*d*) shows a voltage wave form 404 developed across the signal lamp L2 but in this case the portion of the wave form 404 between the instants 405 and 406 is the same as that of the common supply voltage owing to energization of the lamp L2, presumably as a result of a malfunction of the system. FIG. 4(*e*) shows a voltage wave form 407 produced at the output of the sampling latch SL2 in response to the presence of the wave form 404 across the lamp L2.

As in the case of FIG. 3(*f*), FIG. 4(*f*) shows a voltage wave form 408 produced at the output of the conflict detector CD in response to the wave forms simultaneously fed to the terminals T1 and T2 which respectively correspond, in this instance, to the wave forms 403 and 407. Similarly, FIG. 4(*g*) shows a voltage wave form 411 produced at the output of the integrator 5 in response to the wave form 408 at its input and FIG. 4(*h*) shows a resultant voltage wave form 412 produced at the output of the latch 6.

In this case, it will be noted that the wave form 412 goes to the "high" level when the wave 411 reaches the "high" level and returns to the "low" level simultaneously with the reset pulse 402G. The latch 6 is not reset by the reset pulses 402B to 402F because at the time of occurrence of these respective reset pulses the input of the latch 6, which corresponds with the voltage wave form 411, is still at a "high" level so that application of the reset pulses to the latch 6 has no effect. As with FIG. 3(*i*), FIG. 4(*i*) shows a voltage wave form, in this case a wave form 413 developed across the capacitance 204 of the reaction timer stage 7. The +3 volt level in FIG. 4(*i*) is denoted by the horizontal dotted line 414. FIG. 4(*j*) shows a wave form 416 corresponding with the magnitude of current flow in the winding of the relay R1. The current level E corresponds with the magnitude of current producing closure of the relay R1. In this case, the duration of the "high" portion of the voltage wave 412 present at the output of the latch 6 is sufficient for the charge on the capacitance 204 to reach the +3 volt level at the instant 415 with the result that the output of the inverter 9 becomes "low" causing the relays R1 and R2 to drop out, as depicted by the voltage wave form 416, disconnecting the common voltage supply so that the signal lamps L1 and L2 cease to be energized thereby.

In accordance with the invention, the system of FIG. 1 has provision for simulating conflict and non-conflict conditions at the input terminals of the conflict detection means CD and for checking the resultant output therefrom. In this respect, one of the output devices of the microcomputer 2 is a signal group generator SGG provided with eight signal outputs respectively connected to the individual inputs of the respective "OR" gates G1 to G8, the respective outputs of which are connected to the input terminals T1 to T8 of the conflict detector CD. Moreover, one of the input devices of the microcomputer 2 is a multi-input device MID having eight signal inputs respectively connected to the terminals T1 to T8 of the conflict detector CD. In addition, the output of the conflict detector CD is connected to an input port IP1 of the microcomputer 2.

The signal group generator SGG is in the form of an array of eight flip-flop latches, each capable of delivering a logic "1" or a logic "0" at its output in response to instructions and information supplied thereto via the common bus system 3 under the control of the central processing unit CPU and in accordance with the program stored in the permanent memory PM. In addition to the program, within the memory PM is an eight-bit binary number store which may be incremented to cover a full sequence of the 256 possible combinations.

In known manner, the generator SGG as a whole is able to deliver an eight-bit data signal group at its eight parallel outputs corresponding with any eight-bit combination supplied to its inputs from the number store of the memory PM in response to instructions from the central processing unit CPU to transfer corresponding data to its output. It will be appreciated that the number represented by the eight-bit combination is advanced or incremented each time the generator is instructed by the central processor CPU to deliver an output and in this manner a sequence of eight-bit data signal groups is generated by the generator SGG. It will also be appreciated that some combinations correspond with a conflict condition whereas other combinations correspond with a non-conflict condition. Via the "OR" gates G1 to G8, with each program step initiating the generator SGG to deliver the next succeeding eight-bit data signal group of the sequence, the appropriate data signal group is applied to the set of input terminals T1 to T8 of the conflict detector CD.

By way of the multi-input device MID, signals present at the set of terminals T1 to T8 of the conflict detector CD are able to be monitored by the microcomputer 2 and by way of the input port IP1, the state of the output of the conflict detector CD is able to be monitored by the microcomputer 2. The multi-input device MID and the input port IP1 also operate under the control of the central processing unit CPU in accordance with the program stored in the memory PM.

The reference memory REF has separate memory locations which respectively contain data duplicating the resultant information intended to be produced by the conflict detection means CD in response to respective corresponding data signal groups of the sequence.

In operation, the microcomputer 2 controls the energization of the signal lamps L1 to L8 via the output device OPD1 in accordance with a program stored in the memory PM and this signal lamp control system forms no part of the present invention. However, the program includes a sub-program for repeatedly checking the satisfactory operation of the conflict detector CD. This conflict-simulate-check sub-program includes the following sequence of steps which are performed at the occurrence of negative to positive zero-crossover of the alternating supply voltage:

A. Reset the sampling latches SL1 to SL8.

B. Verify that terminals T1 to T8 of the conflict detector CD are all inactive. If any are active, skip the following steps C to G.

C. Supply the next available eight-bit combination from the memory PM to the latches of the generator SGG and cause the latches to retain the corresponding data signal group at its output.

D. Via the input port IP1, read the output data present at the output of the conflict detector CD and temporarily store the data in the temporary store memory TS.

E. Reset the latches of the generator SGG to zero.

F. Address also to the data location of the reference memory REF the eight-bit combination referred to in step C and obtain the data contents of that location.

G. Compare the data referred to in step D with the data referred to in step F.

H. If the two sets of data referred to in step F correspond then (i) set all inputs of the latches of the generator SGG to zero, (ii) cause them to transfer their input information to their respective outputs and (iii) increment by one the eight-bit binary number combination in store in the memory PM.

Alternatively, if the two sets of data referred to in step F do not correspond, the main program is terminated and the steps of an emergency sub-program are followed.

The nature of an emergency sub-program such as that referred to at step H of the foregoing forms no part of the present invention but should be appropriate to the apparatus of which the monitoring system of the present invention forms part. In the case of a traffic signal lamp control and monitoring system, such an emergency program may include the steps of switching-off via the output device OPD1 and the triac devices TD1 to TD8 the supply of energy to all the lamps L1 to L8 and energizing an alarm (not shown) warning operators that the conflict detector CD and/or associated circuitry is defective. However, other possibilities are available and readily conceivable by persons skilled in the art.

As previously indicated, the steps of the conflict-simulate-check sub-program are performed coincident with the occurrence of blank time-spaces of short duration synchronous with and closely following negative to positive zero-crossover of the alternating supply voltage. Accordingly, the presence of each data signal group at the eight parallel outputs of the generator SGG will occur at a time when the output voltage of all of the sensing latches SL1 to SL8 is "low" so that the resultant output of the conflict detector CD will be unaffected by whether or not one or more of the lamps L1 to L8 are connected across the source 1 and whether or not simultaneous connection of two or more lamps so connected corresponds with a conflict condition. In other words, the blank time-spaces referred to provide short periods of time exclusively available for the simulation of conflict conditions at the input terminals T1–T8 of the conflict detector CD and for checking the resultant output thereof.

The blank time-spaces correspond with the interruptions in the wave form 303 of FIG. 3(*c*) when the voltage is at a "low" level and also with similar interruptions in the respective wave forms 403, 407 and 408 of FIGS. 4(*c*), 4(*e*) and 4(*f*).

Each data signal group produced at the output terminals of the generator SGG has a duration of approximately 100 microseconds and the presence of the integrator 5 ensures that the output of the latch 6 is not activated by the resultant conflict signifying information of approximately equivalent duration being produced at the output of the conflict detector CD under conditions when no conflict signifying information is present either before or after the time-space in question.

The embodiment of the invention depicted by FIG. 1 is a simple basic embodiment of the invention and many variations employing the same basic principles will be evident to persons skilled in the art and are intended to be included within the scope of the present invention. For example, the individual voltage sensing devices SD1 to SD8 may be utilized in combination with a gating system to monitor the energization of a plurality of lamps instead of each monitoring a single lamp as illustrated. Also, it will be evident that energizable units other than lamps can be monitored and that the number and the form of the monitor paths supplying data to the input terminals of the conflict monitor CD is not restricted to that shown in FIG. 1. The number of monitor paths will be dictated by the number of input terminals of the conflict detector concerned and the form of each monitor path will be dictated by the design requirements of the monitoring system concerned. It will, of course, be necessary for the monitor paths to be operated in such a way that there are intervals of short duration in the supply of data thereby during which data from the signal group generator is supplied to the terminals of the conflict detector. However, although advantageous in many applications of the invention, it is not an essential feature of the invention for such interruptions to occur periodically or in synchronism with the alternating supply voltage.

In accordance with the program stored in the memory PM, the microcomputer 2 may control the performance of other checking operations carried out in relation to portions of the circuit arrangement of FIG. 1. For this purpose, an input port IP2 and an input port IP3 are respectively connected to the output of the latch 6 and to the output of the reaction timer stage 7.

What is claimed is:

1. A monitoring system for monitoring individual energization of a plurality of energizable units, each connected for controlled switching of energy supplied thereto from a common alternating voltage supply source, and for providing protection against energization of any one of the units of the plurality being in conflict with energization of another unit of the plurality, the system comprising;

conflict detection means provided with a set of input terminals respectively connected, via individual monitor paths, to monitor individual energizable units or groups of energizable units so that respective input terminals of the set are activated in response to energization of respective individual units or groups of units, the conflict detection means generating conflict signifying information at an output thereof in response to simultaneous activation of pre-determined combinations of input terminals of the set, a signal group generator feeding to the set of input terminals a sequence of data signal groups each simulating a conflict or a non-conflict combination at said input terminals whereby the conflict detection means produces resultant information at its output, the resultant information at the output of the conflict detection means being checked for correctness by a verification means operating under common control with the signal group generator, the data signal groups of the sequence being fed to the set of input terminals within simulation signal intervals of fixed duration that are short relative to the supply cycle period of the alternating voltage source and timed to occur during blank time-spaces when no information is fed thereto via the monitor paths, an information processing stage having an acceptance time interval for producing conflict-warning information in response to conflict signifying information present at the conflict detection means output when within the acceptance time interval, and conflict protection means coupled to the information processing stage so as to be activated in response to such conflict-warning information, the acceptance time interval being such that the information processing stage is non-responsive to conflict signifying information resulting from data signal groups produced only within said simulation signal intervals.

2. A monitoring system as claimed in claim 1 wherein the said acceptance time interval is determined by the time period required for a chargeable element forming a part of the information processing stage, to be charged to a fixed threshold level by conflict signifying information produced at the output of the conflict detection means.

3. A monitoring system as claimed in claim 1 wherein the response of the said information processing stage to information present at the said conflict detection means output is inhibited in synchronism with said simulation signal intervals.

4. A monitoring system as claimed in claim 1 wherein a capacitance is connected across data input terminals of a resettable information latch, the output of the conflict detection means being fed via a resistance to the data input terminals of the information latch so that the resistance and capacitance function as an integration network which, in combination with the information latch serves as the said information processing stage, and wherein the time constant of the integration network determines a latch delay time for charging the capacitance from zero to a threshold level for latch activation, the time constant of the integration network being such that the latch delay time is longer than the said fixed duration.

5. A monitoring system as claimed in claim 4 wherein the said information latch is connected so as to be reset by reset pulses so timed that a reset pulse occurs just prior to each said simulation signal interval.

6. A monitoring system as claimed in claim 5 wherein the charging rate and the discharging rate of said capacitance are governed by the same time constant and the reset pulses are of shorter duration than the said fixed duration.

7. A monitoring system as claimed in claim 1 wherein said conflict protection means responds only to activation by conflict warning information present for a continuous period of time exceeding a predetermined conflict measurement period.

8. A monitoring system as claimed in claim 1 further comprising a terminal protection means which inhibits operation of the said signal group generator unless all input terminals of the said set of input terminals are inactive.

9. A monitoring system as claimed in claim 1 wherein each said monitor path includes a resettable latching means, the latching means so included being simultaneously reset at intervals corresponding substantially with zero crossover of the said alternating voltage supply whereby the said blank time-spaces are produced.

10. A monitoring system as claimed in claim 9 wherein the said latching means are periodically reset at intervals corresponding substantially with zero crossover of the said alternating voltage supply.

11. A monitoring system as claimed in claim 1 wherein the said signal group generator and the said verification means operate under the common control of a central processing unit, the verification means including a reference memory containing reference information permitting respective identification of conflict and non-conflict combinations represented by individually fed data signal groups.

12. A monitoring system as claimed in claim 11 wherein the said conflict detection means includes an addressable conflict data memory having address terminals which form the said set of input terminals, said conflict signifying information being stored at those memory locations of the conflict data memory that match memory location addresses corresponding with activation of the respective said pre-determined combinations of input terminals of the set.

13. A monitoring system as claimed in claim 12 wherein each said data signal group of the sequence is related to a memory location address within the said conflict data memory and is also related to correspondingly identifiable reference information stored within the said reference memory.

14. A monitoring system as claimed in claim 13 wherein said sequence of data signal groups is advanced under the control of the central processing unit so that with each advance there is a corresponding advance to a next reference information data stored in the reference memory and the resultant information at the output of the conflict detection means is compared with the reference information of the reference memory so that a fault condition in the conflict detection means is detected in the event of non-correspondence between the two.

15. A monitoring system as claimed in claim 1 wherein said conflict detection means includes an addressable conflict data memory, the address terminals which form the set of input terminal, the conflict signifying information being stored at those memory locations of the conflict data memory which match memory location addresses corresponding to activation of the respective said predetermined combinations of input terminals of the set.

16. A monitoring system as claimed in claim 1 wherein said information processing stage comprises an integration network connected in cascade with a resettable information latch to the output of the conflict detection means, wherein said integration network has a time constant that determines a latch delay time such that the latch delay time is longer than said fixed duration simulation signal interval.

17. A monitoring system as claimed in claim 16 further comprising means for supplying reset pulses to said information latch at intervals corresponding to zero crossover of said alternating voltage supply source, said reset pulses occurring just prior to each said simulation signal intervals.

18. A monitoring system as claimed in claim 1 further comprising a central processing unit (CPU) which provides common control of the signal group generator and the verification means, the verification means including a reference memory containing reference information permitting respective identification of conflict and non-conflict combinations by comparison of said reference information with the resultant information present at the output of the conflict detection means during the simulation signal intervals.

19. A monitoring system as claimed in claim 1 wherein the conflict protection means comprises, a comparison stage having a first input coupled to a reference voltage and a second input coupled to an output of the information processing stage and to a capacitor having a charge and a discharge time constant that are substantially different from one another.

* * * * *

UNITED STATES PATENT AND TRADEMARK OFFICE

CERTIFICATE OF CORRECTION

PATENT NO. : 4,835,534

DATED : MAY 30, 1989

INVENTOR(S) : IAN R. LUCAS

It is certified that error appears in the above-identified patent and that said Letters Patent is hereby corrected as shown below:

Col. 4, Lines 10-11, "PHC 35584" should be --PHO 2298 (corresponding to USP 4,811,010; 3/7/89)--.

Signed and Sealed this

Seventh Day of August, 1990

*Attest:*

*Attesting Officer*

HARRY F. MANBECK, JR.

*Commissioner of Patents and Trademarks*